United States Patent [19]

Schlienger

[11] 3,963,812

[45] June 15, 1976

[54] METHOD AND APPARATUS FOR MAKING HIGH PURITY METALLIC POWDER

[75] Inventor: Max P. Schlienger, San Rafael, Calif.

[73] Assignee: Schlienger, Inc., San Rafael, Calif.

[22] Filed: Jan. 30, 1975

[21] Appl. No.: 545,635

[52] U.S. Cl. ..... 264/8; 75/.5 B; 75/.5 BA; 75/.5 BB; 75/.5 C; 264/10; 425/8

[51] Int. Cl.[2] ..... B22D 23/08

[58] Field of Search ..... 264/8, 10; 425/8; 75/.5 C, .5 B, .5 BA, .5 BB, .5 BC

[56] References Cited

UNITED STATES PATENTS

| | | | |
|---|---|---|---|
| 2,897,539 | 8/1959 | McMillan | 264/10 |
| 3,021,562 | 2/1962 | Chisholm et al. | 264/10 |
| 3,119,685 | 1/1964 | Hansley et al. | 264/10 |
| 3,784,656 | 1/1974 | Kaufmann | 264/8 |
| 3,887,667 | 6/1975 | Clark | 264/8 |

*Primary Examiner*—W. Stallard

*Attorney, Agent, or Firm*—Townsend and Townsend

[57] ABSTRACT

High purity metallic powder is made from high purity metallic rod by positioning the rod above a horizontally oriented, cooled and rotating electrode. An electric potential is applied between the rod and the electrode so that the electrode end porixmate the disc is progressively melted down. Molten droplets are thrown off the disc by centrifugal forces onto a cooled, rotating, concave shield which intercepts the trajectory of the droplets. As the droplets contact the cooled shield they solidify and are deflected into a collector. The melting and cooling operations are performed in a controlled atmosphere, e.g., in a vacuum.

20 Claims, 3 Drawing Figures

METHOD AND APPARATUS FOR MAKING HIGH PURITY METALLIC POWDER

BACKGROUND OF THE INVENTION

Powdered metal has a number of increasingly important applications. It has long been used for making porous metal parts and in the more recent past it has generated great interest in the manufacture of high strength parts of a compound shape. Such parts as are frequently found on aircrafts, spaceships, and the like where minimum weight and high strength are critical. They are made from specially alloyed metals which have the desired characteristics. The parts were heretofore cast and/or forged and then machined to the desired dimensions.

This wastes a great amount of expensive metal, and requires complicated and time-consuming metal-working operations. The costs of such parts is therefore high.

It has been recognized that high-strength parts, with or without compound shapes and surfaces can be made from powder of the alloy in question by pressing and then sintering the powder. Material wastes are thereby greatly reduced or eliminated and in many instances parts can be made to their finished dimensions to eliminate complicated machining. Substantial cost savings can thereby be achieved.

Difficulties are encountered, however, in making the required high volume of metal powder. The powder must be of the correct particle size and possess proper physical and chemical characteristics; contamination of the powder cannot be tolerated. Such contamination may result from chemical reactions between the heated or molten metal, and the surrounding atmosphere or from substances with which the molten metal comes into contact or when the metal is mechanically powderized, from an intermixing of abrasive agents, chips and the like with the powder.

There is, therefore, a present need for a method of transforming solid metal into powder without contaminating the resulting powder. Furthermore, to enable the economic exploitation of the above-mentioned metal powder forming and sintering processes, it is necessary that uncontaminated, high purity powder can be made at a low cost.

SUMMARY OF THE INVENTION

The present invention provides method and apparatus for transforming a solid metal object, e.g., a solid metal rod into fine, uncontaminated powder. The present invention accomplishes this in a simple, expedient and inexpensive manner. It is therefore ideally suited to provide the powder material necessary for making low weight, high strength sintered parts of compound configurations such as are frequently used in aircraft and aerospace applications.

Generally speaking, the method of the present invention contemplates the transformation of a solid, high purity metal rod into powder of equal purity by progressively melting the rod, mechanically disintegrating the molten metal into fine droplets and thereafter cooling and solidifing the droplets while preventing them from adhering or welding together before they have solidified. The resulting product is a powdery metal substance. The method is performed in a controlled atmosphere, e.g., in a vacuum or in an inert atmosphere, which prevents chemical or physical changes of the metal in its molten state, and to thereby maintain the high purity of the original solid metal after it has been powderized.

In practicing the method of the present invention, a cooled, horizontally disposed disc electrode is rotated about a vertical axis and an elongated rod made of the metal to be powderized is positioned above the disc so that a lower end thereof is proximate the disc. When a potential is applied across the rod and the disc, the proximate rod end is progressively melted down. The disc is rotated at a rate so that the linear speed of the disc portion underlying the rod is between about 7,000 to 10,000 feet per minute. Molten metal falling on the disc is thereby thrown off the disc by centrifugal forces. As the molten metal is thrown off it disintegrates into smaller droplets. A shield is positioned to intercept the trajectory of the droplets. The shield is cooled so that the droplets, when they impinge on the shield, are both further disintegrated into still smaller particles and their temperature is simultaneously sufficiently reduced so that the particles solidify. The particles are deflected by the shield, preferably in a downward direction, and are then collected as a powder consisting of fine particles with an unimpaired purity.

The space surrounding the disc, the rod and the shield is either vacuumized or filled with an inert gas to prevent chemical interactions which may change the purity or contaminate the molten metal. The shield is defined by a concave surface which faces the disc and on which the droplets impinge and it is rotated about a horizontal axis so that different portions of the surface are successfully subjected to the impact of the molten droplets. This allows the disc, which is cooled by flowing a cooling fluid through internal cooling passages to cool down which in turn prevents solidified particles from collecting on or adhering to the surface.

The electrode disc and the solid metal rod are movable with respect to each other to compensate for metal consumed i.e., molten from the rod while maintaining the space between the rod end and the disc within desired limits. The rod can be mounted vertically or at an oblique angle with respect to the disc. In the latter case, the rod is rotated about its axis so that the rod is conically melted down. Furthermore, for certain application, that is for certain alloys which may have a greater affinity to the impinging surface of the shield, it may be desirable or necessary to include a mechanical wiper which continuously or intermittently removes therefrom solidified metal particles collecting thereon.

Both the method and the apparatus of the present invention enable the formation of metal powder from virtually any metal alloy without changing the purity of the powderized metal. The powder can be made in an efficient manner in a relatively low cost apparatus and the production of the powder can be closely controlled. Thus, by changing one or more of the voltage across the metal rod and the disc electrode, the current flowing through the electrode, the speed, the vacuum or the inert gas atmosphere, finished particles sizes and shapes can be controlled to suit end use requirements for the powder. Consequently, the present invention enables the manufacture of high quality metal powder in an economical manner which makes it ideally suited for subsequent use in making pressed and sintered high quality metal parts.

DESCRIPTION OF THE PREFERRED EMBODIMENTS

Figure 1:
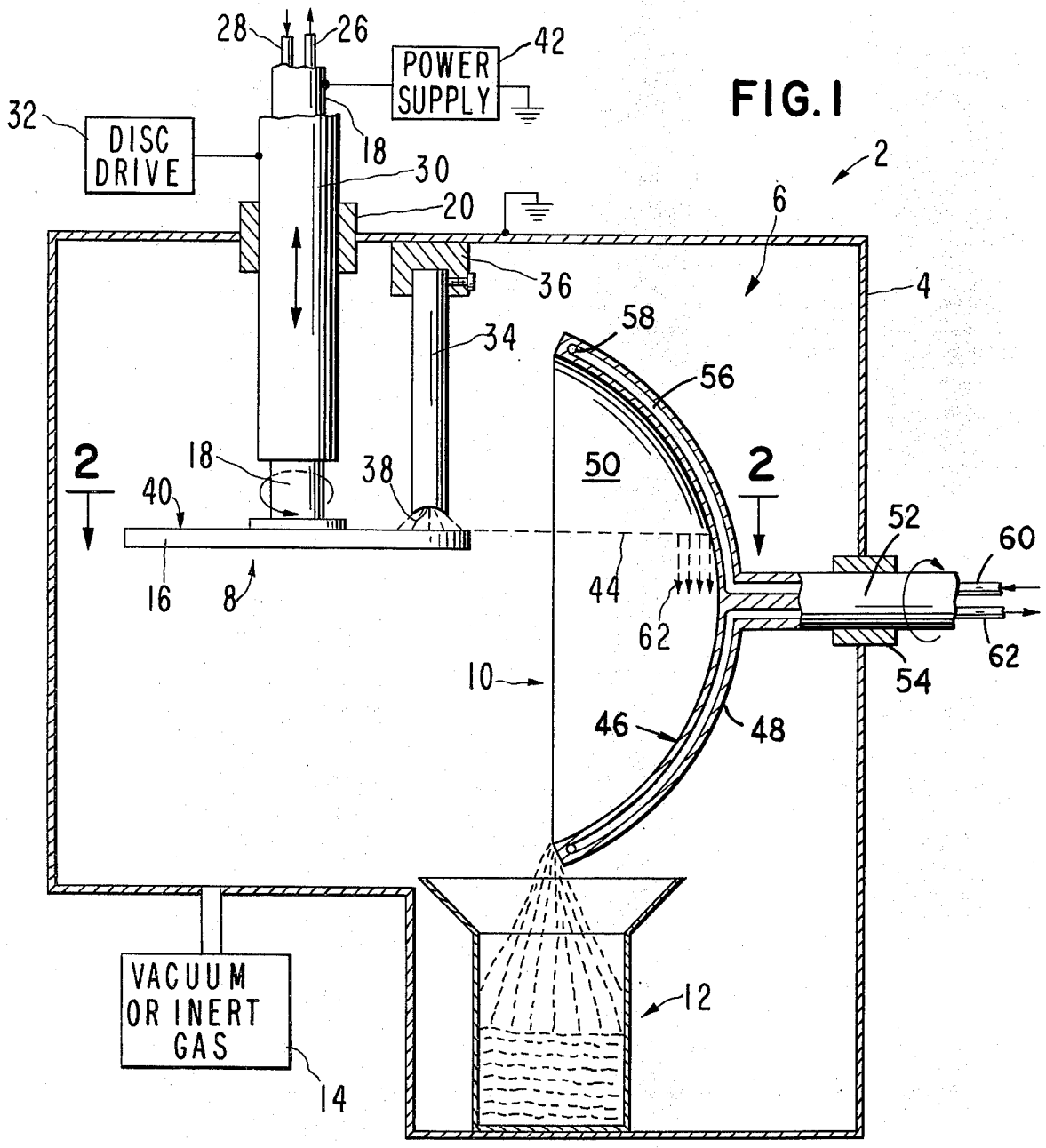
FIG. 1 is a side elevation, in section, of a device constructed in accordance with the present invention for transforming a metal rod into metal powder.
Figure 2:
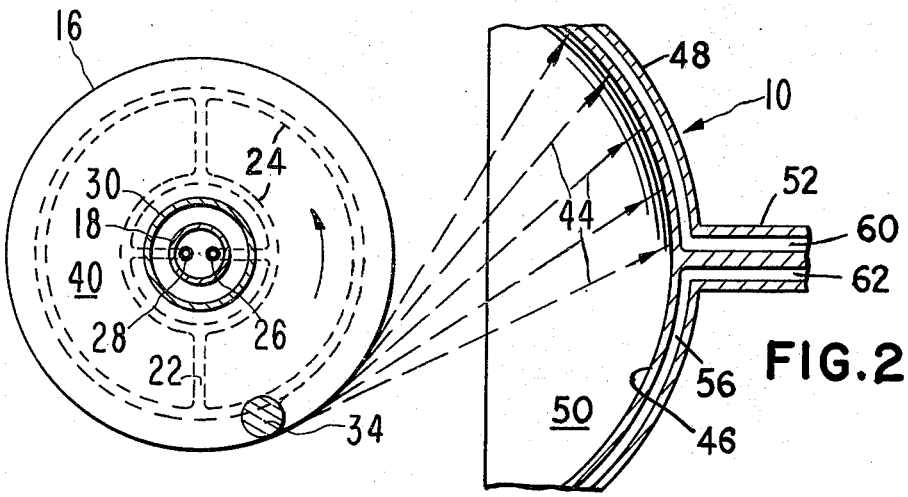
FIG. 2 is a fragmentary plan view, also in section, and is taken on line 2—2 of FIG. 1.

Referring to FIGS. 1 and 2, a powder forming device 2 constructed in accordance with the present invention generally comprises an airtight outer housing 4 which encloses an inner space 6, and disposed within the inner space, a metal melting and accelerating station 8, a molten metal disintegrating and cooling station 10 and a powdered metal collector 12 positioned at the bottom of the device. The housing is connected to a vacuum pump or a source of inert gas 14, hereinafter vacuum source, for evacuating the inner space 6 or, alternatively, for filling the inner space with an inert gas, that is a gas which does not adversely interact (chemically or physically) with metal being molten at melting station 8.

The melting station 8 is defined by a horizontally disposed electrode disc 16 mounted to a vertically extending, shaft 18. The disc includes internal passages, such as radial passages 22 and circular passages 24 which fluidly communicate with a pair of conduits 26, 28, to which a cooling medium such as water is flowed to cool the disc.

Shaft 18 is rotatably disposed within a sleeve 30 which is vertically movable in a bearing mounted to housing 4, and suitable drive means 32 is provided for rotating the shaft and axially moving the sleeve. The drive means also permit an increase or decrease in the rate of rotation of the shaft and, therewith of the disc.

The metal to be powderized is supplied from a solid, elongated metal rod 34 which is vertically oriented and which depends from and is secured to a rod holder 36. A lower end 38 of the rod is above and proximate to but spaced apart from an upper surface 40 of disc electrode 18. An electric power supply 42 and rod 34 have a common ground and the power supply establishes a voltage potential between the rod and the electrode disc. When the potential is of sufficient magnitude, an arc discharge between the lower rod end and the disc electrode progressively melts metal from the lower rod end. Molten metal gravitationally drops onto the upper disc electrode surface. Drive means 32 rotates the electrode at a sufficient rate so that the molten metal droplets are thrown off the disc along a predetermined trajectory path which is schematically indicated in FIG. 2 by trajectory lines 44. For most metals sufficient centrifugal forces are generated when the linear speed of the disc portion underlying rod 34 is between about 7,000 to about 10,000 feet per minute. As the molten metal flies off the disc, it disintegrates.

A cooling and disintegrating shield or plate 46 is positioned at cooling station 10 and is defined by a generally cup-shaped plate 48 which has a concave impinging surface 50 facing melting station 8. The cup-shaped plate is mounted to a shaft 52 mounted in a journal 54 for rotation about a horizontal axis. The cup-shaped plate includes radial and circular cooling fluid passages 56 and 58, respectively, which can be connected with a source of a cooling fluid such as cooling water via conduits 60 and 62.

The cup-shaped plate has a sufficient diameter and curvature radius so that it extends over a substantial portion of the periphery of electrode disc 16, and so that only a portion of concave surface 50 intercepts the molten droplet trajectory path 44. When the molten droplets impinge on the concave surface, they are further disintegrated into small particles, and simultaneously therewith, heat is transferred from the droplets to the concave plate. This results in an almost instantaneous formation of small, solidified metal particles so that which neither adhere nor weld to each other. The cooling water flowing through passages 56, 58 in the cup-shaped plate assures a plate temperature greatly below the temperature of the molten metal. The small, solidified particles, therefore do not adhere or weld to the plate but are recoiled or by positioning the concave surface so that the trajectory path impinges on the surface at the upper half of the cup-shaped member (as viewed in FIG. 1) the particles are deflected in a generally downward direction, as indicated by arrows 62 both away from melting station 8 (to prevent the particles from interfering with the melting operation) and toward powder collector 12.

The operation of the powder forming device should be apparent from the above description. To briefly summarize it, a solid metal rod 34 is mounted in holder 36 and vacuum source 14 is energized to form a vacuum in space 6. Disc drive means 32 is energized to adjust the spacing between lower rod end 38 and upper disc surface 40 to the desired value by raising or lowering sleeve 30 and the drive means rotates disc 16 at the desired rate. Power supply 42 is energized and the resulting potential between the rod and the disc electrode causes an arc discharge which in turn progressively melts the rod from its lower end toward holder 36. As metal is removed from the rod the drive means raises the disc to maintain the spacing between the rod and the disc within the required limits.

The molten metal drips onto the disc and centrifugal forces propel molten metal droplets along trajectory path 44. Cooling shield 46 intercepts all or most of the molten metal droplets. The shield rotates about a horizontal axis so that a new portion is continuously moved into the trajectory path. This movement of the shield allows it to be continuously cooled so that the concave surface portion upon which the molten droplets impinge does not overheat and maintains a sufficiently low temperature to assure the solidification of the small particles and to prevent such particles from adhering or welding to the shield surface. The solidified particles are deflected, normally in the downward direction indicated by arrows 62, and are then collected in collector 12 for the subsequent removal and use.

Figure 3:
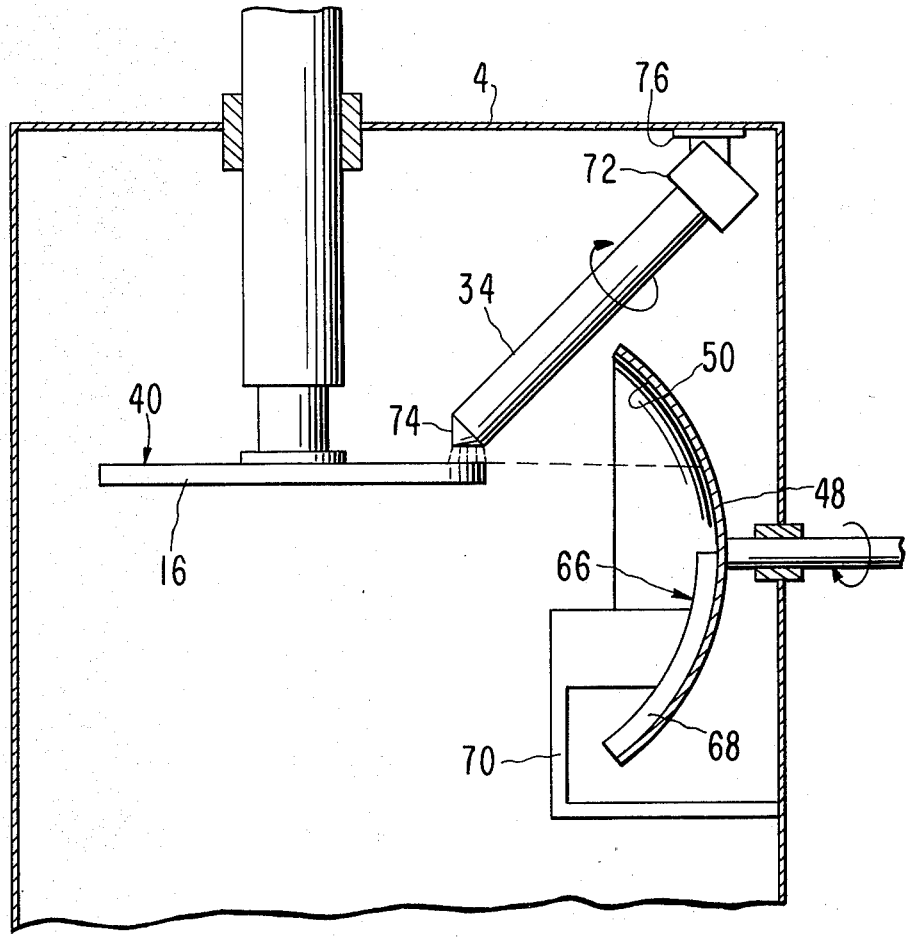
FIG. 3 is a fragmentary side elevational view, similar to FIG. 1, showing another embodiment of the present invention.

Referring now to FIGS. 1 through 3, under certain operating conditions, or when melting certain alloys, some solidified particles may collect on concave shield surface 50. To prevent such particles from being subsequently contacted by molten metal droplets propelled from the rotating disc, a mechanical wiper 66 may be provided. Such a wiper will normally comprise a blade 68, the edge of which scapes over concave surface 50. The blade is suitably mounted to a support structure 70, which for illustrative purposes, is shown mounted to housing 4.

In an alternative embodiment rod 34 may be mounted so that its axis is obliquely inclined relative to disc electrode 16. Rod holder 36 then includes means 72 for rotating the rod about its axis. As in the previously discussed embodiment there is an arc discharge between the lower end of the rod and the disc. However, due to the inclination of the disc axis, a conical end 74 is formed as the rod end melts. In this embodiment it may further be necessary to move the rod horizontally relative to the electrode disc and for that purpose the rod holder and the rotating means are mounted to a suitably operated horizontal sled 76 which can move the rod in a radial direction (relative to the disc) towards and away from the disc axis. In all other respects, this embodiment is constructed and operated identically to the previously discussed embodiment of the invention.

I claim:

1. A method for powderizing a solid metal object having a first transverse dimension comprising the steps of: rotating a disc electrode, the electrode having a second transverse dimension parallel to the first dimension which is substantially larger than the first transverse dimension; positioning the object between the axis of rotation of the electrode and a periphery thereof in close proximity with the electrode; applying an electrical potential between the object and the disc to form an arc and melt portions of the object proximate the disc; whereby molten metal droplets drop onto the disc and such droplets are thrown off the disc by centrifugal forces; impinging thrown off metal droplets on a surface having a temperature substantially less than the temperature of the molten droplets so that the droplets solidify without adhering to each other and to the surface; moving the surface in a direction generally transverse to the direction in which the molten droplets are thrown off the disc; and collecting the solidified droplets.

2. A method according to claim 1 wherein the surface is defined by plate means including cooling passages, and including the step of flowing a cooling fluid through the passages to thereby cool the surface.

3. A method according to claim 1 including the step of intermittently wiping the surface to remove therefrom solidified particles adhering thereto.

4. A method according to claim 1 including the step of directing the droplets towards a portion of the moving surface where the surface deflects the impinging droplets in a generally downward direction, and wherein the collecting step includes the step of collecting the solidified particles beneath the surface.

5. A method according to claim 1 wherein the step of rotating includes the step of rotating the disc at a linear speed of between about 7,000 to about 10,000 feet per minute measured at the radial distance of the object from the axis of rotation.

6. A method according to claim 1 wherein the object comprises an elongate electrode having an end disposed proximate the disc, and including the steps of positioning the electrode at an oblique angle relative to the disc, and rotating the electrode about its axis while the potential is applied to thereby give said one end of the electrode a conical shape while the voltage is applied and metal is molten therefrom.

7. A method for transforming a high purity metallic rod into high purity metal powder comprising the steps of providing an electrode disc having internal cooling passages; positioning the rod over the disc so that an end thereof is proximate the disc; rotating the disc about a vertical axis at a rate sufficient to cause molten metal from the rod to fly off the disc under centrifugal forces; applying a sufficient voltage across the rod and the electrode to form an arc therebetween and melt said rod end; positioning upright plate means in the trajectory of molten metal droplets flying off the disc; moving the plate means transversely with respect to said trajectory so that molten droplets impinge on different portions of the plate means; cooling the plate means sufficiently to cause impinging molten droplets to be cooled and solidified; whereby the molten droplets are transformed into solid, powder-like metal particles without adhering to each other; controlling the atmosphere in which the rod is molten and the molten droplets travel from the disc to the plate means to maintain the purity of the metal; and collecting solidified particles.

8. A method according to claim 7 including the step of adjusting the size of the solidified particles by changing at least one of the voltage between the electrode and the disc, the current flowing through the electrode, the rate of rotation of the disc, or the atmosphere surrounding the rod, the disc and the plate means.

9. A method according to claim 7 including the step of employing the moving plate means to impart to the particles a downward motion away from the plate means, and wherein the collecting step is performed at a point below the plate means.

10. A method according to claim 9 wherein the plate means comprises a concavely shaped plate, and wherein the step of moving the plate means comprises the step of rotating the plate about a generally horizontal axis.

11. A method according to claim 10 wherein the plate includes internal cooling fluid passages, and including the step of flowing a cooling medium through the passages.

12. Apparatus for powderizing a solid metal object comprising: a cooled disc electrode and means for rotating the electrode about a vertical axis; means positioning the electrode closely adjacent the disc at a point spaced from the axis of rotation of the disc; means for applying a voltage across the object and the disc to thereby cause spark discharges therebetween and progressively melt the object; a cooled shield mounted adjacent the disc and having a surface positioned to intercept molten metal particles thrown off the disc under centrifugal forces generated by the rotating disc; means for rotating the shield about a substantially horizontal axis so that the molten particles intermittently impinge on substantially all parts of the surface; whereby molten particles impinging the shield are cooled and solidified to form a powdery substance; and means for collecting the solidified particles.

13. Apparatus according to claim 12 wherein the surface has a concave configuration.

14. Apparatus according to claim 13 wherein the shield is positioned so that molten particles impinging on the surface are deflected generally in a downward direction, and wherein the collecting means is positioned below the shield.

15. Apparatus according to claim 12 wherein the object comprises an elongated metallic rod, and including means mounting the rod at an oblique angle relative to the disc; and means for rotating the rod about its longitudinal axis so that metal molten from the rod forms a generally conical rod end when the voltage is applied.

16. Apparatus for transforming an elongated high purity metallic rod into metal powder of a like purity comprising:

means defining and enclosing a space sealed from the atmosphere;

a flat electrode disc including interior cooling passages, means for flowing a cooling fluid through the passages, means mounting the disc in a generally horizontal orientation, and means for rotating the disc about a vertical axis;

means mounting the rod in a generally upright orientation in the space and positioning an end of the rod proximate to and above the disc at a point radially spaced from the disc axis;

means for subjecting the disc and the rod to a sufficient electrical potential to cause a progressive melting of said rod end, whereby molten metal drips from the rod onto the upper disc surface and is thrown off the disc surface in the form of molten metal droplets along a trajectory path;

a shield having a surface positioned to intercept the droplets travelling along the trajectory path and means for moving the surface transversely to the path; whereby molten droplets impinge on and are cooled by the shield surface and are deflected thereby as cooled and solidified small metal particles;

means positioned within the space for receiving and collecting the cooled and solidified particles which form a powdery substance; and means for controlling the atmosphere in the space to prevent the inclusion of impurities in the powder.

17. Apparatus according to claim 16 wherein the surface has a concave configuration, and including means positioning the shield so that the portion of the surface intercepting the trajectory path deflects the cooled and solidified particles downwardly, and wherein the collecting means is disposed below the shield.

18. Apparatus according to claim 16 wherein the rod mounting means includes means for mounting the rod in a generally inclined position relative to the disc.

19. Apparatus according to claim 16 including control means for varying at least one of the voltage between the rod and the electrode disc, the current flowing through the electrode, the rate of rotation of the electrode disc, or the atmosphere in the space to thereby vary the size of the solidified particles forming the metallic powder.

20. Apparatus according to claim 16 including means for wiping the surface to remove therefrom solidified metallic particles that collect thereon.

* * * * *